US006482265B1

(12) United States Patent
Falck et al.

(10) Patent No.: US 6,482,265 B1
(45) Date of Patent: Nov. 19, 2002

(54) COATER HEAD UNIT FOR METAL STRIP COATING APPARATUS

(75) Inventors: Michael E. Falck, Wanatah, IN (US); Norbert A. Satkoski, Union Mills, IN (US)

(73) Assignee: Roll Coater, Inc., Greenfield, IN (US)

( * ) Notice: Subject to any disclaimer, the term of this patent is extended or adjusted under 35 U.S.C. 154(b) by 0 days.

(21) Appl. No.: 09/785,378

(22) Filed: Feb. 16, 2001

Related U.S. Application Data

(60) Provisional application No. 60/183,065, filed on Feb. 16, 2000, and provisional application No. 60/212,272, filed on Jun. 19, 2000.

(51) Int. Cl.[7] ..... B05C 1/06

(52) U.S. Cl. ..... 118/681; 118/226; 118/256; 118/264

(58) Field of Search ..... 118/679–681, 258, 118/323, 325, 419; 101/479, 480, 182, DIG. 35; 162/265, 272; 239/750, 225.1; 222/160; 427/428, 429; 68/205 R

(56) References Cited

U.S. PATENT DOCUMENTS

| | | | | |
|---|---|---|---|---|
| 3,617,444 A | | 11/1971 | Hundseid | 162/275 |
| 4,111,120 A | * | 9/1978 | Paulson | 101/175 |
| 4,604,300 A | | 8/1986 | Keys et al. | |
| 4,934,264 A | * | 6/1990 | Gansky et al. | 101/175 |
| 5,125,339 A | * | 6/1992 | Rogge | 101/182 |
| 5,549,752 A | | 8/1996 | Hahn et al. | |
| 5,985,028 A | | 11/1999 | Cornell et al. | |
| 6,013,312 A | | 1/2000 | Cornell et al. | |
| 6,125,758 A | * | 10/2000 | Sato et al. | 101/479 |
| 6,152,068 A | * | 11/2000 | Colson et al. | 101/479 |

* cited by examiner

*Primary Examiner*—Laura Edwards
(74) *Attorney, Agent, or Firm*—Barnes & Thornburg

(57) ABSTRACT

A coating apparatus includes a coating applicator carried on a frame. The frame and the coating applicator cooperate to define a coating region. The coating applicator applies coating material to a moving strip of material when the moving strip is in the coating region. The frame is arranged to be moved from an on-line position placing the moving strip in the coating region to an off-line position removing the moving strip from the coating region.

20 Claims, 7 Drawing Sheets

COATER HEAD UNIT FOR METAL STRIP COATING APPARATUS

This application claims priority under 35 U.S.C. §119(e) to U.S. Provisional Application Ser. No. 60/183,065, filed Feb. 16, 2000 and U.S. Provisional Application Ser. No. 60/212,272, filed Jun. 19, 2000, which are expressly incorporated by reference herein.

BACKGROUND AND SUMMARY OF THE INVENTION

The present invention relates to a coating apparatus, and particularly to an apparatus for coating strip material. More particularly, the present invention relates to a coater head unit for a metal strip coating apparatus.

Coating apparatus are configured to apply a coating onto material. See, for example, U.S. Pat. No. 6,013,312 to Cornell et al., U.S. Pat. No. 5,985,028 to Cornell et al., U.S. Pat. No. 5,549,752 to Hahn et al., and U.S. Pat. No. 4,604,300 to Keys et al.

According to the present invention, a coating apparatus for coating a moving strip of material includes a first coating applicator configured to apply coating material to the moving strip of material when the moving strip is in a coating region and a frame configured to carry the first coating applicator, the frame and the first coating applicator cooperating to define the coating region. The coating apparatus further includes means for providing relative movement between the moving strip and the frame carrying the coating applicator so that the frame can be moved from an online position to an offline position away from the moving strip causing the moving strip to leave the coating region.

In preferred embodiments, the coating apparatus further includes a second coating applicator and the frame includes an upper arm, a lower arm, and a support base interconnecting the upper arm and the lower arm. The upper arm carries the first coating applicator and includes a first proximal end mounted on the support base and a first distal end. The lower arm carries the second coating applicator and includes a second proximal end mounted on the support base and a second distal end spaced apart from the first distal end to form an opening that opens into the coating region. The moving strip passes through the opening when the moving strip is moved into and out of the coating region as the coater is moved between the online and offline positions.

In other preferred embodiments, the coating apparatus includes a first coater and a second coater. The first and second coaters have wheels coupled to their frames so that the coaters can shuttle along separate rails between the online and offline positions.

In yet other preferred embodiments, the frames of the first and second coaters are coupled to a rotatable mover. The rotatable mover pivots the frames of the first and second coaters about an axis of rotation between the online and offline positions.

Additional features of the present invention will become apparent to those skilled in the art upon consideration of the following detailed description of the invention.

BRIEF DESCRIPTION OF THE DRAWINGS

The detailed description particularly refers to the accompanying figures in which:

FIG. 4 is a top plan view of the front and rear coater heads at time interval $t_1$ showing the front coater head as the operational coater head and the rear coater head disposed in the offline position;

FIG. 5 is a top plan view of the front and rear coater heads at time interval $t_2$ showing the front coater head as still the operational coater head and the rear coater head disposed also in the online position but not in fluid communication with the liquid coating material;

FIG. 6 is a top plan view of the front and rear coater heads at time interval $t_3$ showing the operational coater head having been switched to the rear coater head and the front coater head still disposed in the online position but not in fluid communication with the liquid coating material;

FIG. 7 is a top plan view of the front and rear coater heads at time interval $t_4$ showing the rear coater head as the operational coater head and the front coater head having been shuttled to the offline position;

DETAILED DESCRIPTION OF THE DRAWINGS

Figure 3:
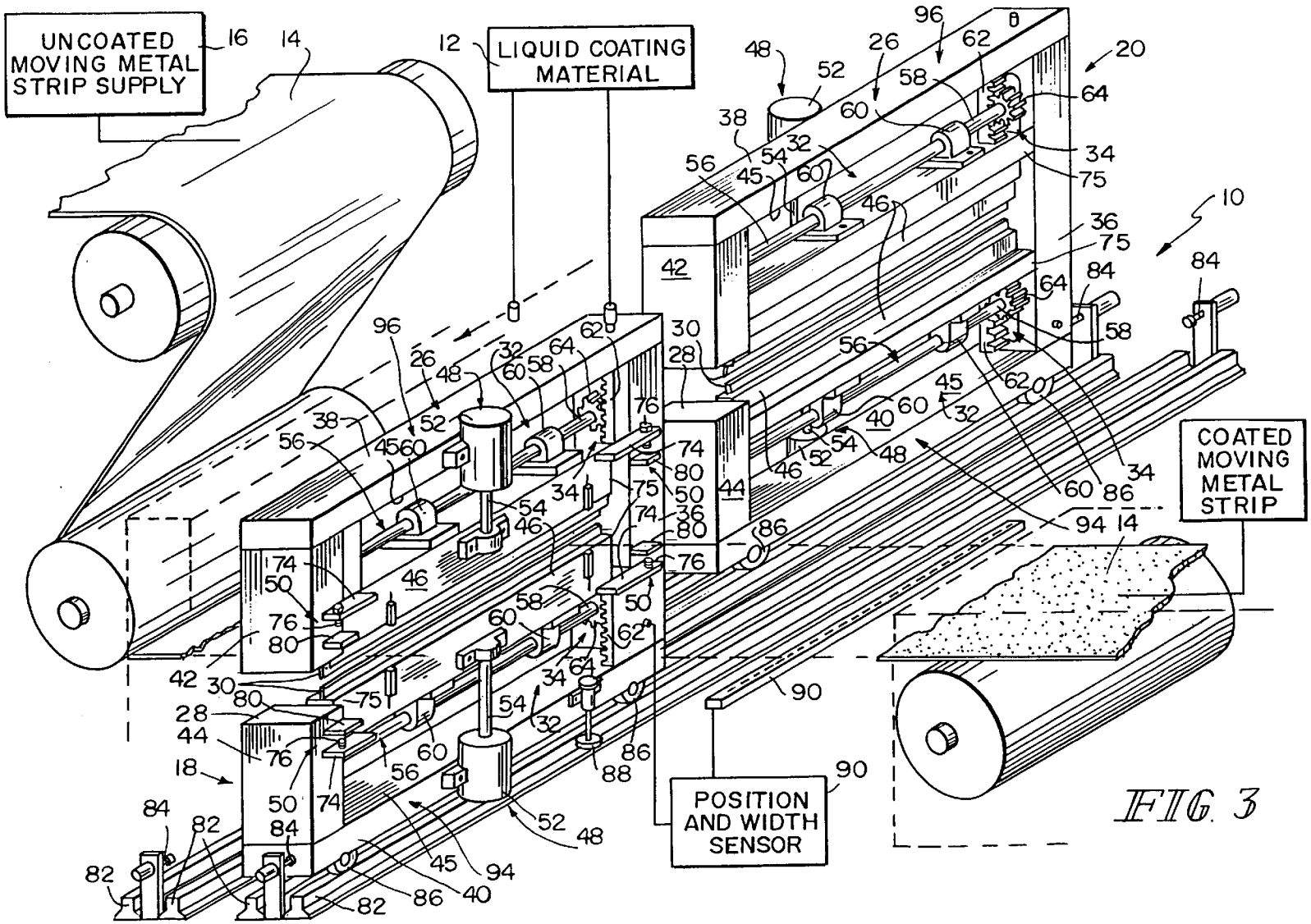
FIG. 3 is a perspective view of the shuttle coater head unit shown diagramatically in FIGS. 1 and 2 showing the coater head unit including a front coater head and a rear coater head, the front coater head disposed in the online position for applying the liquid coating material to the moving metal strip, the rear coater head disposed in the offline position.

A coater head unit 10 in accordance with the present invention is configured to efficiently and safely apply a liquid coating material 12 to a metal strip 14 moving at high speeds and provided by a metal strip supply 16. Coater head unit 10 includes a pair of coater heads 18, 20, as shown in FIG. 3. Coater head unit 10 is configured to require no downtime on the production line of moving metal strip 14 during changeover of coater heads 18, 20, whereas existing equipment requires approximately two hours for changeover. Furthermore, coater head unit 10 is configured to permit setup and cleaning of coater heads 18, 20 to take place out of the production line to maximize safety of operating personnel.

Figure 1:
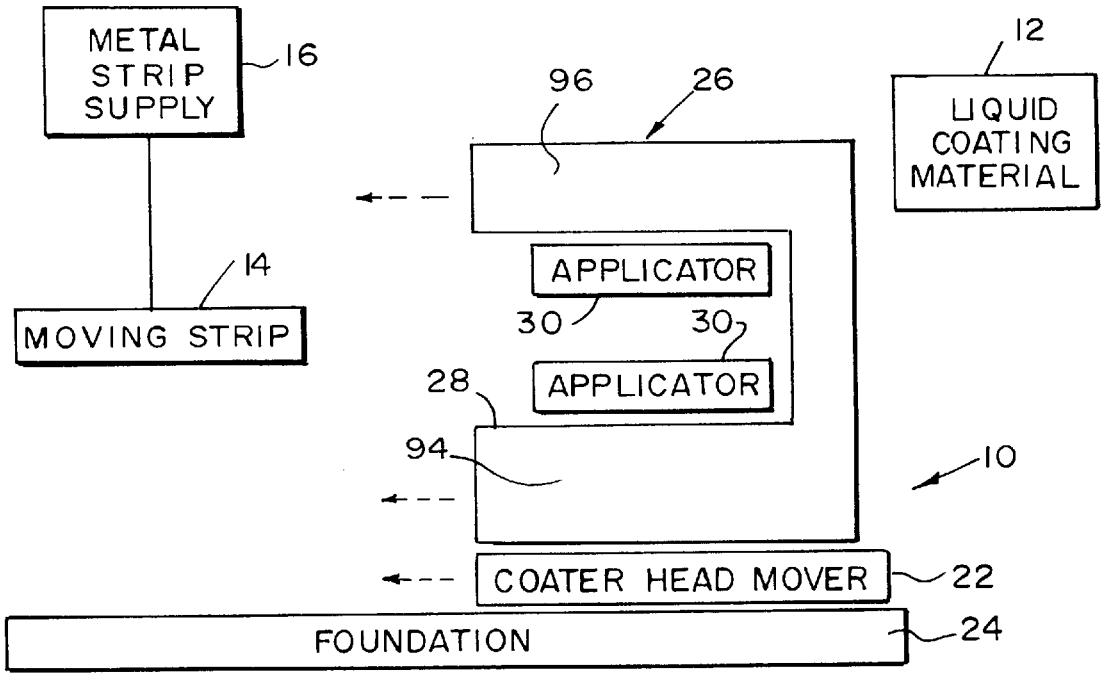
FIG. 1 is a diagrammatic view of a preferred embodiment of the present invention showing a coater head including a C-shaped frame and a pair of applicators, the coater head being disposed in an offline position spaced apart from a moving metal strip provided by a metal strip supply and decoupled from a liquid coating material, the C-shaped frame including an opening sized to receive the moving metal strip, the coater head being movable by a coater head mover along a foundation between the offline position and an online position (not shown)
Figure 2:
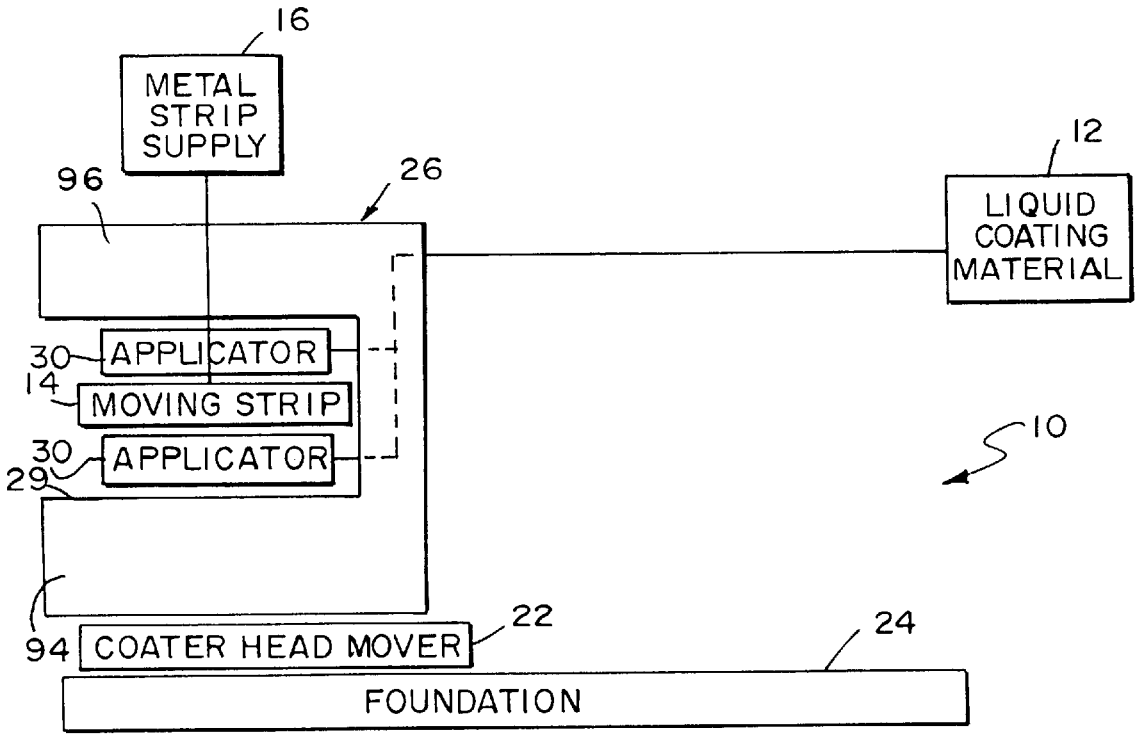
FIG. 2 is a view similar to FIG. 1 showing the coater head disposed in the online position and in fluid communication with the liquid coating material, the moving metal strip being positioned between the pair of applicators for applying the liquid coating material to the moving metal strip.

Coater head unit 10 further includes a pair of coater head movers 22. Each coater head 18, 20 of coater head unit 10 is mounted on respective coater head mover 22 for shuttling respective coater head 18, 20 along a suitable foundation 24 into and out of the production line of moving metal strip 14 between an offline position spaced apart from the production line, as shown in FIG. 1, and an online position adjacent to the production line, as shown in FIG. 2. When one coater head 18, 20 is disposed in the online position to coat moving metal strip 14, the other coater head 18, 20 can be disposed in the offline position for servicing, for example, as production continues.

Each coater head 18, 20 includes a C-shaped frame 26 having an opening 28 sized to receive moving metal strip 14 so that respective coater head can be shuttled into and out of the production line without disassembling respective coater head 18, 20 or cutting metal strip 14. Furthermore, each coater head 18, 20 includes a pair of applicators 30 configured to be coupled to liquid coating material 12 and to sandwich moving metal strip 14 for applying liquid coating material 12 thereto, as shown in FIG. 2.

Figure 8:
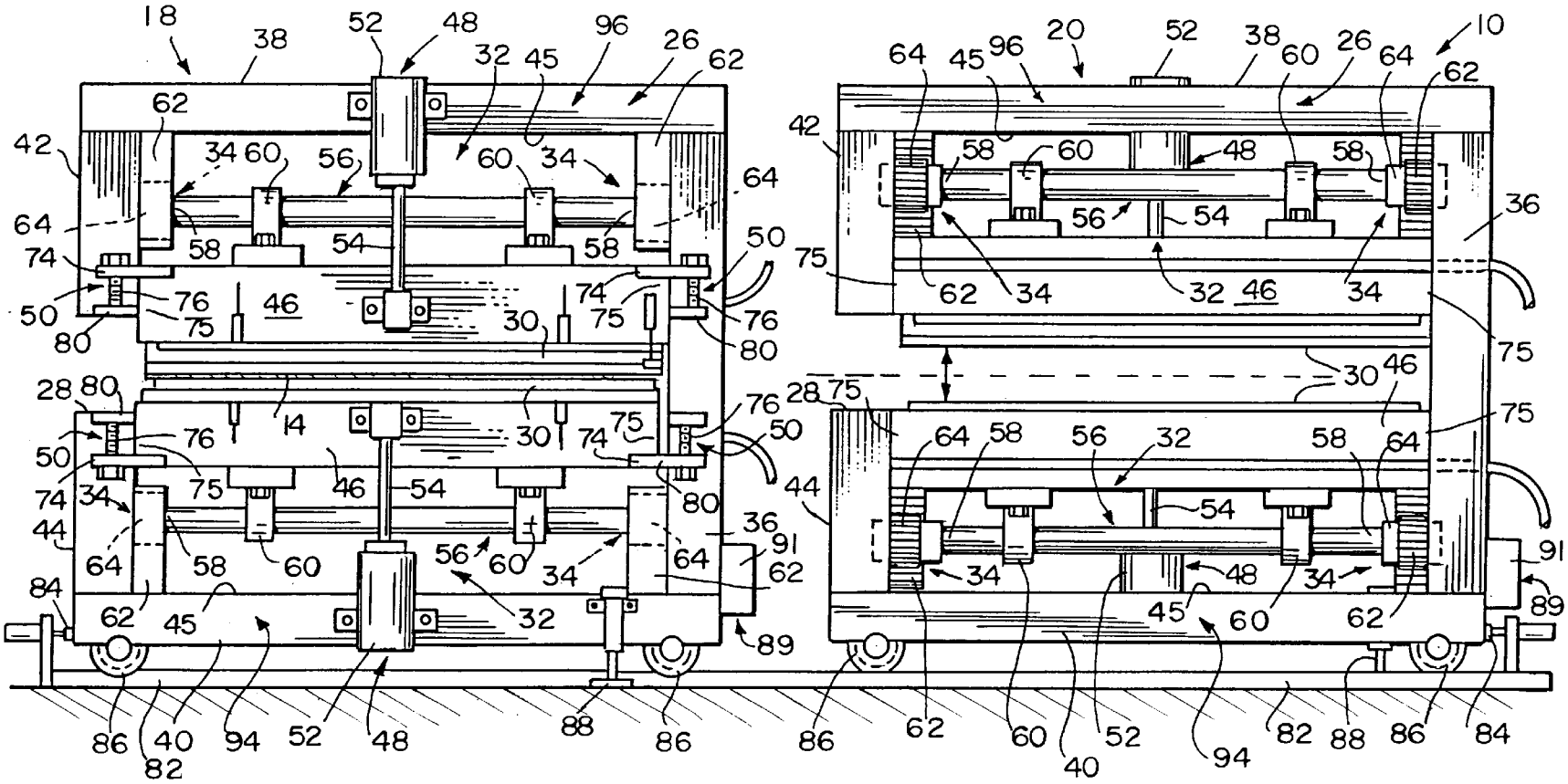
FIG. 8 is a front elevational view of the coater head unit of FIG. 3 showing the front coater head on the left side disposed in the online position with its applicators in a closed position for applying the liquid coating material to the metal strip moving therebetween and the rear coater head on the right side disposed in the offline position with its applicators in an opened position.

In addition, each coater head 18, 20 is configured to move applicators 30 up and down between a closed position for applying liquid coating material 12 to moving metal strip 14 and an opened position so that applicators 30 are vertically spaced apart from moving metal strip 14, as shown in FIG. 8. Each coater head unit 10 includes a pair of alignment units 32 that each includes a pair of rack and pinion units 34 coupled to respective applicator 30 to ensure that respective applicator 30 contacts moving metal strip 14 smoothly and evenly, as discussed in detail below.

Coater head unit 10 includes a front coater head 18 and a rear coater head 20 positioned to lie in offset, adjacent relation to front coater head 18, as shown in FIG. 3. Each of front and rear coater heads 18, 20 are movable between the online and offline positions so that coater heads 18, 20 can be shuttled into and out of the production line in any combination—both in, both out, and one in and one out. As referenced herein, an operational coater head is considered to be the coater head disposed in the online position with its applicators 30 protracted to the closed position in order to apply liquid coating material 12 to respective surface of moving metal strip 14.

Figure 4:
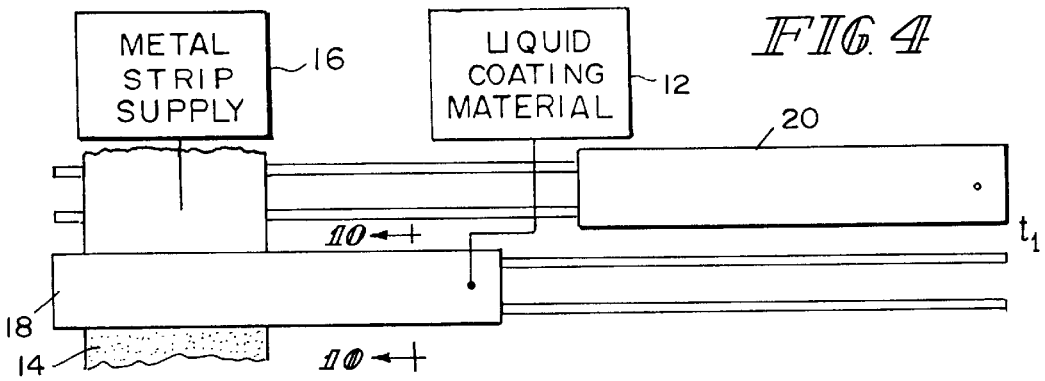
FIGS. 4–7 are top plan views of the front and rear coater heads of FIG. 3 showing instantaneous "snapshots" from time interval $t_1$ to time interval $t_4$, respectively, of the sequence for switching the operational coater head in the online position and in fluid communication with the liquid coating material from the front coater head to the rear coater head while the metal strip continues moving and coater head unit continues applying the liquid coating material thereto.

The operational coater head can be easily switched between front and rear coater heads 18, 20, as shown, for example, in FIGS. 4–7 between time intervals $t_1$ and $t_4$. Illustratively, at time interval $t_1$, front coater head 18, as the operational coater head, is disposed in the online position and coupled in fluid communication with liquid coating material 12 to deposit liquid coating material 12 on moving metal strip 14, whereas rear coater head 20 is disposed in the offline position and not in fluid communication with liquid coating material 12, as shown in FIG. 4.

Figure 5:
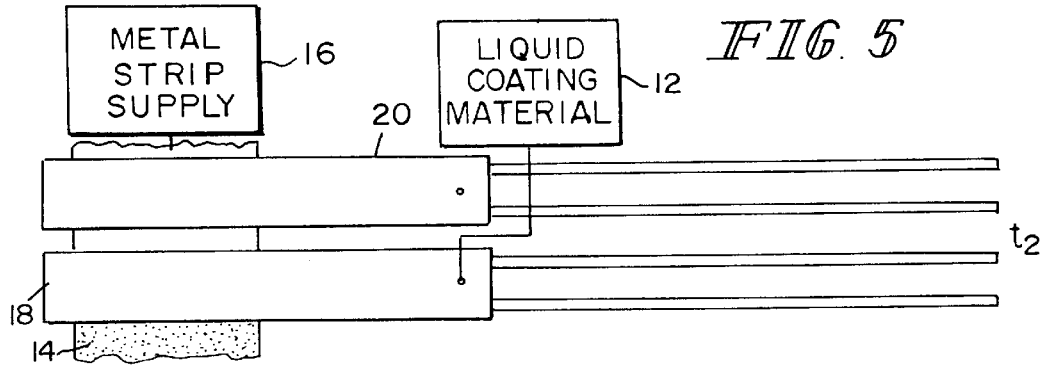
Figure 6:
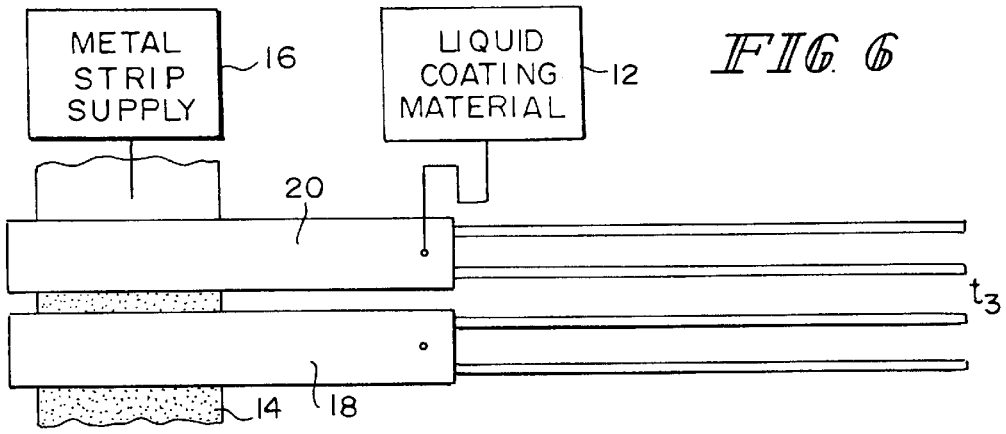

At time interval $t_2$, both front and rear coater heads 18, 20 are disposed in the online position, as shown in FIG. 5, but front coater head 18 remains the operational coater head as front coater head 18 is in fluid communication with liquid coating material 12 and rear coater head 20 is not in fluid communication with liquid coating material 12. At time interval $t_3$, both front and rear coater heads 18, 20 remain disposed in the online position, but rear coater head 20, rather than front coater head 18, is in fluid communication with liquid coating material 12, as shown in FIG. 6. Between time intervals $t_2$ and $t_3$, there is a short interval of time in which both coater heads 18, 20 are in fluid communication with liquid coating material 12 and apply liquid coating material 12 to moving metal strip 14 to ensure that moving metal strip 14 is continuously coating with liquid coating material 12 to avoid coating material gaps on moving metal strip 14.

Figure 7:
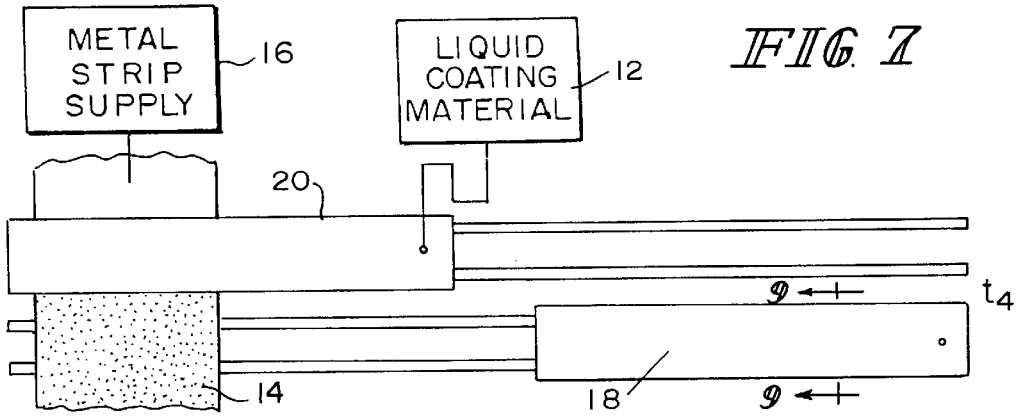

At time interval $t_4$, front and rear coater heads 18, 20 are disposed in the offline and online positions, respectively. Accordingly, rear coater head 20, rather than front coater head 18, is in fluid communication with liquid coating material 12, as shown in FIG. 7. Thus, between time intervals $t_1$ and $t_4$, the operational coater head can easily be switched between front and rear coater heads 18, 20.

C-shaped frame 26 is made of structural steel members welded or bolted, or both, together and configured to provide the requisite structural support for the components of respective coating head 18, 20 and the clamping force developed in respective coater head 18, 20. In preferred embodiments, C-shaped frame is made of square tubing.

C-shaped frame 26 includes a support base or base vertical section 36, upper and lower horizontal sections 3 8, 40, and upper and lower vertical sections 42, 44, as shown, for example, in FIGS. 3 and 8. Base vertical section 36 forms the "back" of the C of C-shaped frame 26. Lower horizontal section 40 is coupled to and extends longitudinally away from base vertical section 36. Lower vertical section 44 is coupled to lower horizontal section 40 and is spaced apart from base vertical section 36 so that lower horizontal and lower vertical sections 40, 44 cooperate to define the lower "curve" of the C of C-shaped frame 26. Lower horizontal section 40 and Lower vertical section 44 cooperate to define a lower arm 94 of frame 26.

Upper horizontal section 38 is coupled to and extends longitudinally away from base vertical section 36. Upper vertical section 42 is coupled to upper horizontal section 38 and spaced apart from base vertical section 36 so that upper horizontal and upper vertical sections 38, 42 cooperate to define the upper "curve" of the C of C-shaped frame 26. Upper horizontal section 38 and upper vertical section 42 cooperate to define an upper arm 96 of frame 26.

Upper and lower vertical sections 42, 44 are positioned to lie in spaced-apart, vertical relation to each other so that upper and lower vertical sections 42, 44 cooperate to define opening 28 therebetween. Opening 28 is sized to receive moving metal strip 14 in order to insert moving metal strip 14 between respective applicators 30 without requiring disassembling of respective coater head 18, 20 or cutting moving metal strip 14. Opening 28 opens into an region 45 defined by sections of C-shaped frame 26.

Applicators 30 are made of a fluid-wicking, felt material, or other suitable material, and are configured to apply liquid coating material 12 to moving metal strip 14. Applicators 30 extend longitudinally and horizontally within region 45 of C-shaped frame 26 and are positioned to lie in spaced-apart, vertical relation to each other, as shown in FIGS. 3 and 8. Each applicator 30 is movable up and down relative to C-shaped frame 26 between the opened position where applicators 30 are spaced apart from moving metal strip 14 and the closed position where applicators 30 contact the upper and lower surfaces of moving metal strip 14 to wipe liquid coating material 12 onto moving metal strip 14, as shown in FIG. 8. Each applicator 30 is sufficiently long to apply liquid coating material 12 along the entire width of moving metal strip 14.

Each coater head 18, 20 further includes a pair of applicator bars 46 each coupled to respective applicator 30, a pair of applicator movers 48 interconnecting C-shaped frame 26 and respective applicator bar 46 for moving respective applicator 30 up and down between the opened and closed positions, pair of alignment units 32 for maintaining respective applicator 30 in parallel relation to moving metal strip 14, and four mechanical stop units 50 for limiting the travel of applicators 30 toward moving metal strip 14.

Each applicator bar 46 is coupled to respective applicator 30 to move respective applicator 30 up and down therewith relative to C-shaped frame 26 as determined by respective applicator mover 48 and is in fluid communication with respective applicator 30 to deliver liquid coating material 12 thereto. Each applicator bar 46 is positioned to lie within region 45 of C-shaped frame 26 between respective applicator 30 and respective horizontal section of C-shaped frame 26 and extends longitudinally and horizontally between base vertical section 36 and respective upper or lower vertical section 42, 44 of C-shaped frame 26, as shown in FIGS. 3 and 8. Furthermore, applicator bars 46 are positioned to lie in spaced-apart, vertical relation to each other. Each applicator bar 46 is retained between gibs (not shown) fixed to frame 26.

Applicator movers 48 are configured to open and close coater heads by moving applicators 30 up and down between the opened position and closed positions. Each applicator mover 48 includes an air cylinder 52 mounted to respective horizontal section 38, 40 of C-shaped frame 26 and a piston rod 54 coupled to respective applicator bar 46. Each air cylinder 52 actuates respective piston rod 54 to move respective applicator bar 46 and respective applicator 30 between the opened and closed positions. Each air cylinder 52 includes a flow-control valve (not shown) to control the travel speed of respective applicator 30 and a built-in cushion stop (not shown) to stop respective applicator 30 in a smooth, controlled manner. In addition, each applicator mover 48 includes a solenoid directional valve (not shown) that is energized to provide air to an appropriate air cylinder 52 port (not shown) to move respective applicator 30 up or down. It is understood that other suitable mechanisms for moving applicators 30 vertically is within the scope of this disclosure.

Each coater head 18, 20 includes pair of alignment units 32, as shown in FIGS. 3 and 8, that cooperate with applicator movers 48 to ensure that respective applicator 30 contacts moving metal strip 14 along the width of moving metal strip 14 evenly and smoothly, as shown in FIG. 8. Each alignment unit 32 is positioned to lie in region 45 of C-shaped frame 26 and includes a shaft 56, pair of rack and pinion units 34 coupled to either end 58 of shaft 56, and a pair of pillow block bearings 60 coupling shaft 56 to respective applicator bar 46 for rotation relative thereto.

Each rack and pinion unit 34 includes a rack 62 and a pinion 64 that operate in the conventional way. Each rack 62 is fixed to C-shaped frame 26 adjacent to respective sections 36, 38, 40, 42, 44 of C-shaped frame 26. Each pinion 64 is fixed to respective end 58 of respective shaft 56 so that pinions 64 rotate with respective shaft 56 which is configured to rotate in respective bearings 60.

Figure 9:
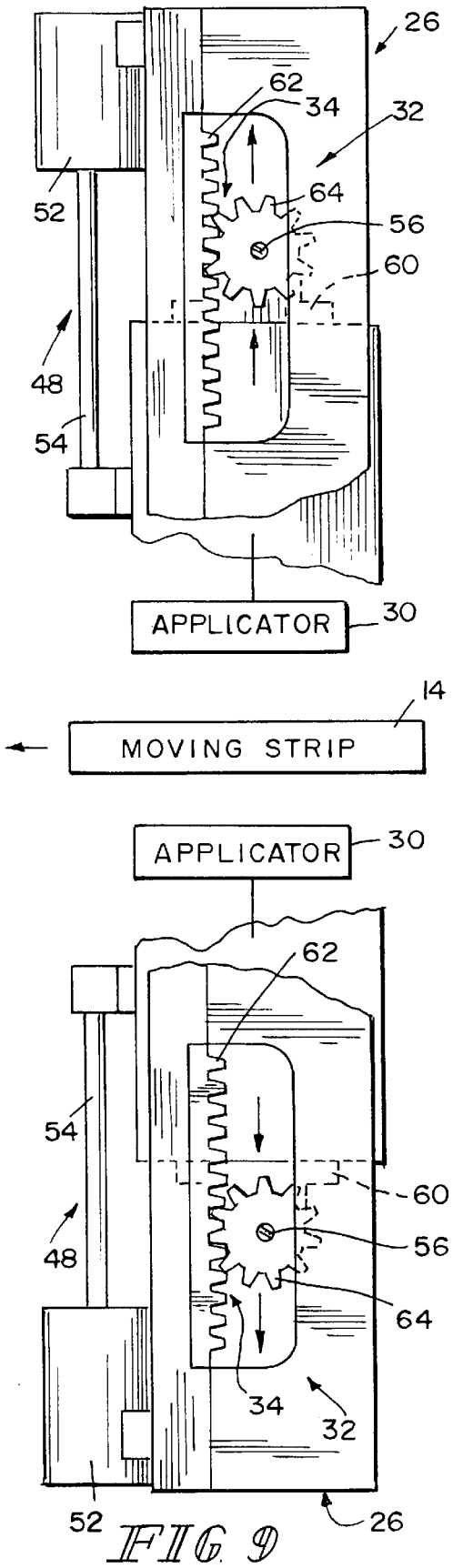
FIG. 9 is an enlarged, side elevational view of the front coater head taken along line 9—9 of FIG. 7, with portions cut away, showing a pair of rack and pinion units coupled to the respective applicator retracted to the opened position to maintain the respective applicator parallel to the moving metal strip.
Figure 10:
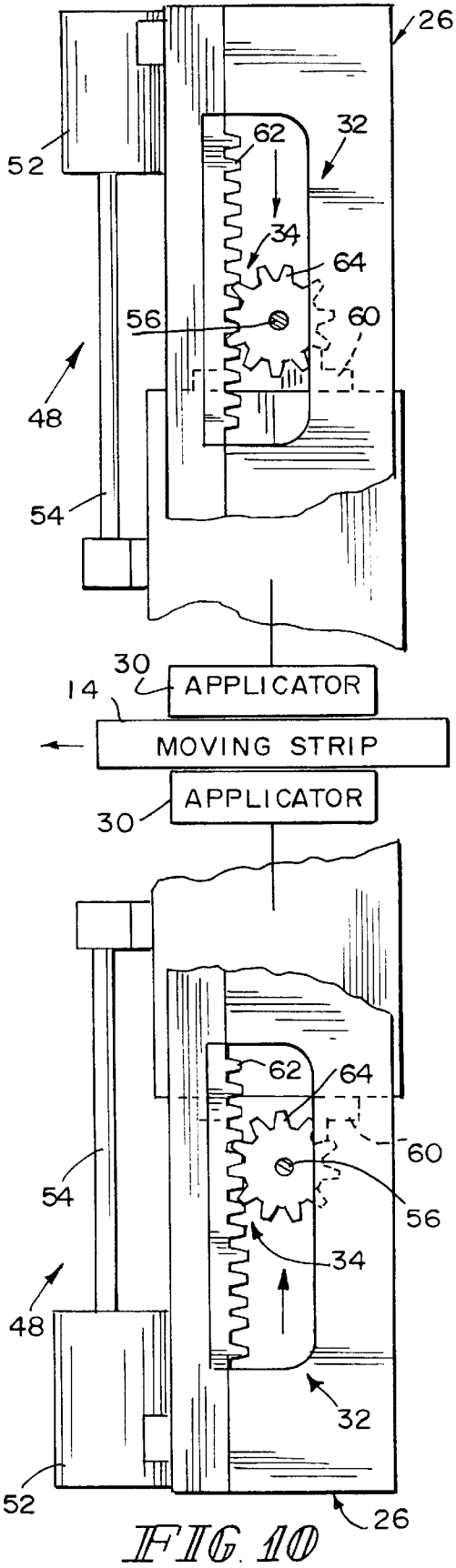
FIG. 10 is an enlarged, side elevational view of the front coater head taken along line 10—10 of FIG. 4, with portions cut away, showing the pair of rack and pinion units of FIG. 9 coupled to the respective applicator protracted to the closed position to maintain the respective applicator parallel to the moving metal strip.

When each piston rod 54 withdraws into respective air cylinder 52, opinions 64 and shaft 56 of respective alignment unit 32 along with respective applicator 30 travel away from moving metal strip 14 to the opened position, as shown in FIG. 9 with respect to front coater head 18. As each piston rod 54 extends 58 from respective air cylinder 52, respective pinions 64 and shaft 56 along with respective applicator 30 travel toward moving metal strip 14 to the closed position, as shown in FIG. 10 with respect to front coater head 18.

Figure 11:
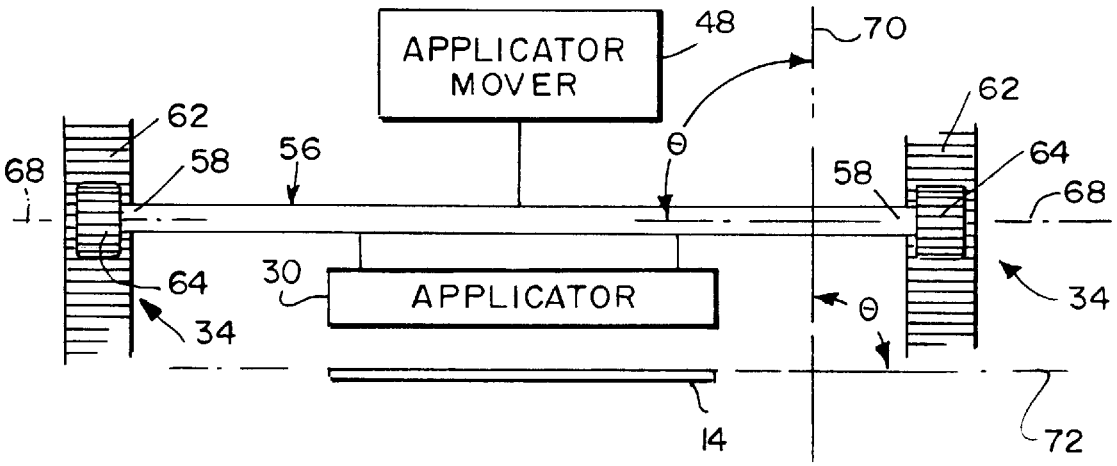
FIG. 11 is a front elevational view showing an applicator mover of a coater head coupled to a shaft, an applicator disposed in the opened position and mounted to the shaft, and a pair of rack and pinion units coupled to the ends of the shaft, and further showing the rack and pinion units positioning the shaft to form an angle θ and the moving metal strip also forming the angle θ with the vertical axis so that the applicator is maintained in parallel relation to the moving metal strip.
Figure 12:
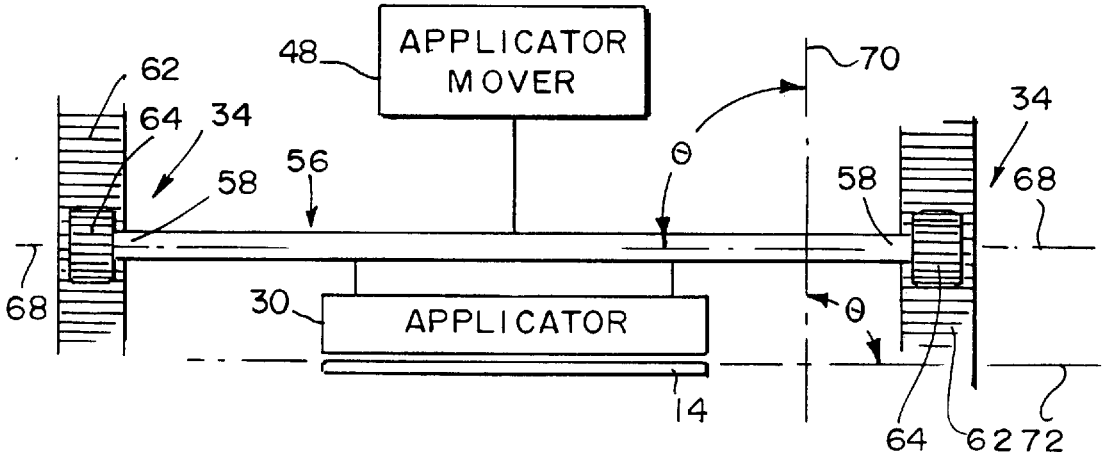
FIG. 12 is a front elevational view similar to FIG. 11 showing the rack and pinion units positioning the shaft at the angle θ with the vertical axis when the applicator is disposed in the closed position so that the applicator is maintained in parallel relation to the moving metal strip.

Each alignment unit 32 maintains respective applicator 30 in parallel relation to the respective surface of moving metal strip 14 as respective coater head 18, 20 opens and closes, as shown in FIGS. 11 and 12. Maintaining respective applicator 30 in this configuration avoids damage to respective applicator 30 that could otherwise occur by contacting moving metal strip 14 unevenly and assists in achieving the desired coating on moving metal strip 14. In the opened position, rack and pinion units 34 of respective alignment unit 32 position a longitudinal, central axis 68 of respective shaft 56 so that central axis 68 is perpendicular to a vertical axis 70 to form an angle $\theta$ of 90 degrees, as shown in FIG. 11. As a result, at the same time, a horizontal axis 72 parallel to the respective surface of moving metal strip 14 is similarly positioned perpendicular to vertical axis 70 to form angle $\theta$ of 90 degrees so that respective applicator 30 is maintained in parallel relation to the respective surface of moving metal strip 14. Rack and pinion units 34 maintain this parallel relation between respective applicator 30 and respective surface of moving metal strip 14 as respective applicator 30 is protracted to the closed position as well, as shown in FIG. 12.

In preferred embodiments, each coater head 18, 20 includes a pair of coupling units (not shown) to maintain the teeth of each pinion 64 engaged with respective rack 62 during vertical movement of respective pinions 64 and shaft 56. Each coupling unit includes a metal guide formed to include an elongated vertical slot therethrough. The metal guide of one of the coupling units is fixed to upper horizontal section 38 about midway between upper vertical section 42 and base vertical section 36 and descends downwardly from upper horizontal section 38. The metal guide of the other of the coupling units is fixed to lower horizontal section 40 about midway between lower vertical section 44 and base vertical section 36 and extends upwardly from lower horizontal section 40.

The slot of each metal guide is sized to receive one of shafts 56 so that each shaft 56 extends through the slot of the respective metal guide. Each coupling unit further includes a bearing coupled to a middle section of respective shaft 56 and the respective metal guide so that each bearing rides along the respective metal guide as respective shaft 56 moves up and down. In this way, the teeth of each pinion 64 is pressed against respective rack 62 for engagement therebetween during vertical movement of each shaft 56.

Mechanical stop units 50 are configured to adjustably limit the movement of respective applicator bar 46 toward moving metal strip 14, as shown in FIG. 3, to prevent damage to applicators 30. Each mechanical stop unit 50 includes a bar lug 74 fixed to an end 75 of respective applicator bar 46, a threaded post 76 threadedly coupled to a threaded aperture (not shown) of bar lug 74, and a frame lug 80 fixed to C-shaped frame 26. Being fixed to respective applicator bar 46, each bar lug 74 and post 76 moves up and down along with respective applicator bar 46. Each post 76 abuts respective frame lug 80 to stop respective applicator bar 46 and applicator 30 from moving toward moving metal strip 14 any farther when respective bar lug 74 is disposed a predetermined distance away from respective frame lug 80. The predetermined distance between respective applicator bar 46 and frame lugs 80 can be adjusted by threading respective post 76 into or out of the respective aperture, as the case may be.

Each coater head 18, 20 is mounted on respective coater head mover 22 for shuttling respective coater head between the offline and online positions along foundation 24. Foundation 24 includes two pairs of steel rails 82 and a base (not shown) that supports steel rails 82. Coater head unit 10 further includes a pair of mechanical shock absorber stops 84 coupled to foundation 24 to limit movement of respective coater head 18, 20 beyond the offline and online positions. The base is made of structural steel members welded or bolted, or both, together, although any suitable base is within the scope of this disclosure. Each coater head 18, 20 is coupled to respective pair of steel rails 82 for shuttling back and forth along steel rails 82.

Each coater head mover 22 includes a pair of steel axles (not shown) coupled to C-shaped frame 26 of respective coater head 18, 20, four rotary elements or flanged steel wheels 86 each mounted on one of the steel axles through a bearing 66 (not shown) and mounted on one of steel rails 82 for rolling engagement, and a driver 89, shown in FIG. 8, for moving respective coater head 18, 20 between the offline and online positions. Driver 89 includes an air motor (not shown), a sprocket (not shown) coupled to the air motor, and a chain (not shown) coupled between the sprocket and the axle that is positioned below base vertical section 36 of respective C-shaped frame 26, and a driver guard 91 shown in FIG. 8 and configured to at least partially cover the air motor, the sprocket, and the chain. Driver 89 further includes a flow-control valve (not shown), a solenoid directional valve (not shown), and an air-actuated lock 88 shown in FIGS. 3 and 8. The flow-control valve is coupled in fluid communication with the air motor to control the shuttle speed of respective coater head 18, 20. The solenoid directional valve is coupled in fluid communication with the air motor and is energized to provide air to an appropriate port (not shown) of the air motor to shuttle respective coater head 18, 20 back and forth between the online and offline positions. The lock 88 is configured to clamp to respective rail 82 to hold respective coater head 18, 20 in place when respective coater head 18, 20 is stationary. Any suitable driver 89 for moving respective coater head 18, 20, including a cable-style air cylinder, is within the scope of this disclosure.

Coater head unit 10 further includes a sensor 90 that is configured to detect the position and width of moving metal strip 14, as shown in FIG. 3. Preferably, sensor 90 is a light screen system obtained from Banner Engineering Corporation of Minneapolis, Minn. that generates a curtain of sensing beams of light to detect the position and width of moving metal strip 14. Sensor 90 is configured to provide a signal indicative of the position and width of metal strip 14 to a programmable logic controller (not shown). In turn, the programmable logic controller is configured to control the delivery of liquid coating material 12 to the portions of each applicator 30 corresponding to the position and width of moving metal strip 14, thereby limiting the wastage of liquid coating material 12. A steering unit (not shown) could also be used to track the position and width of moving metal strip 14 and to move respective coater head 18, 20.

Figure 14:
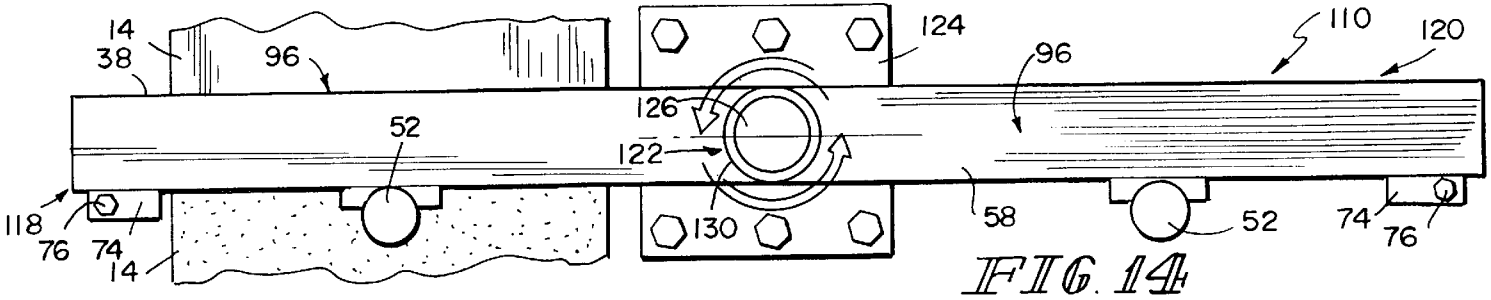
FIG. 14 is a top plan view of the rotary coater head unit of FIG. 13 showing the coater head unit rotatable in the counterclockwise direction (shown by arrows).
Figure 13:
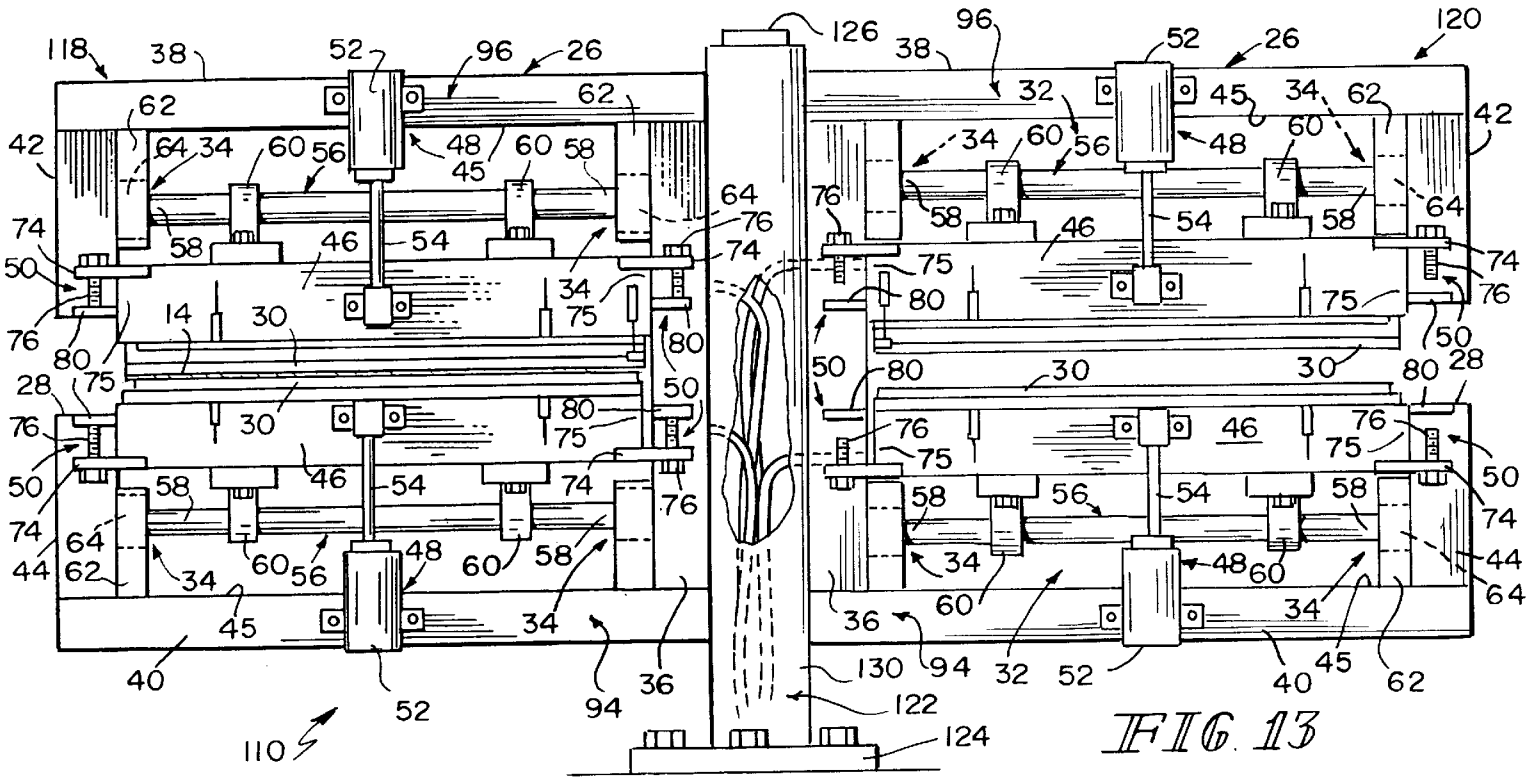
FIG. 13 is a front elevational view of an alternative embodiment of the present invention showing a rotary coater head unit having a pair of C-shaped coater heads coupled to a coater head mover for pivotal movement thereabout.

In an alternative embodiment of the present invention, a coater head unit 110 is configured for rotational movement relative to a foundation 124, as shown in FIGS. 13 and 14. Rotary coater head unit 110 includes first and second coater heads 118, 120. The structure and operation of first and second coater heads 118, 120 is similar to the structure and operation of front and rear coater heads 18, 20 of shuttle coater head unit 10, except as noted otherwise, so that the same reference numerals refer to similar structures.

Coater heads 118, 120 are mounted on a vertical, rotatable coater head mover 122 for pivotal movement of coater heads 118, 120 relative to foundation 124. Coater heads 118, 120 are mounted diametrically opposed to each other on vertical coater head mover 122 such that coater heads 118, 120 extend radially outwardly from coater head mover 122. When first coater head 118 is disposed in the online position for applying liquid coating material 12 to moving metal strip 14, second coater head 120 is disposed in the offline position for servicing, for example, as shown in FIG. 13, and vice versa.

Coater head mover 122 includes a stationary center post 126, a rotatable sleeve 130 surrounding post 126, and a bearing (not shown) positioned to lie between post 126 and sleeve 130 to permit sleeve 130 to rotate relative to post 126 to pivot coater heads 118, 120. Coater head mover 122 further includes an air-actuated lock (not shown) to lock sleeve 130 to post 126 to hold coater heads 118, 120 in the selected position.

Each coater head 118, 120 includes C-shaped frame 26 including opening 28 spaced apart from coater head mover 122 and sized to receive moving metal strip 14 so that each coater head 118, 120 can be pivoted into and out of the production line without disassembling respective coater head 118, 120 or cutting metal trip 14. Base vertical support 36 of each coater head 118, 120 is mounted on coater head mover 122. Each coater head 118, 120 further includes applicators 30, pair of applicator bars 46 coupled to respective applicator 30, pair of applicator movers 48 coupled to respective applicator bar 46 and respective horizontal section 38, 40, and pair of alignment units 32 coupled to C-shaped frame 26 and respective applicator bar 46 for vertical movement of applicators 30 in a smooth and even manner, as previously discussed with respect to shuttle coater head unit 10.

Coater head unit 110 can be rotated 180 degrees to easily switch the operational coater head between first and second coater heads 118, 120. First and second coater heads 118, 120 are disposed initially in the online and offline positions, respectively, and applicators 30 of first and second coater heads 118, 120 are disposed initially in the closed and opened positions, respectively, as shown in FIG. 13. Before pivoting coater heads 118, 120, first coater head 118 is opened as each applicator mover 48 of first coater head 118 retracts respective applicator 30 of first coater head 118 to the opened position so that first coater head 118 can be pivoted away from moving metal strip 14. At the same time, applicators 30 of second coater head 120 are retracted to the opened position, if not already in that position, to prepare for insertion of moving metal strip 14 therebetween through opening 28 of second coater head unit 120. Each alignment unit 32 ensures the movement of respective applicator 30 is smooth and even, as previously discussed. Coater head mover 122 then rotates coater head unit 110 180 degrees to pivot each of first and second coater heads 118, 120 to the opposite position so that first and second coater heads 118, 120 are disposed in the offline and online positions, respectively. As this occurs, moving metal strip 14 exits first coater head unit 110 through opening 28 of first coater head 118. Subsequently, moving metal strip 14 is inserted through opening 28 of second coater head 120 between applicators 30 of second coater head 120. Coater head unit 110 does not apply liquid coating material 12 to moving metal strip 14 during the brief period that coater head unit 110 is rotated. Second coater head 120 is then closed as each applicator mover 122 of second coater head 120 protracts respective applicator 30 to the closed position so that applicators 30 of second coater head 120 sandwich moving metal strip 14 to apply liquid coating material 12 thereto. Each alignment unit 32 of second coater head 120 maintains respective applicator 30 in parallel relation to respective surface of moving metal strip 14, as previously discussed.

Sensor 90 (not shown in FIGS. 13 and 14) detects the position and width of moving metal strip 14 and provides a signal indicative thereof to the programmable logic controller (not shown). The programmable logic controller in turn determines which portions of respective applicator 30 receives liquid coating material 12, as previously discussed.

Although the invention has been described in detail with reference to preferred embodiments, variations and modifications exist within the scope and spirit of the invention as described and defined in the following claims.

What is claimed is:

1. A coating apparatus for coating a moving strip of material, the coating apparatus comprising a coating applicator configured to apply coating material to a moving strip of material when the moving strip is in a coating region, a frame configured to carry the coating applicator, the frame and the coating applicator cooperating to define the coating region, and means for providing relative movement between the moving strip and the frame carrying the coating applicator so that the frame can be moved at a non-parallel angle to the moving strip from an online position to an offline position away from the moving strip causing the moving strip to leave the coating region.

2. The coating apparatus of claim 1, wherein the means for providing relative movement includes a rail and a rotary element coupled to the rail and the frame to permit the frame to be shuttled between the online and offline positions.

3. A coating apparatus for coating a moving strip of material, the coating apparatus comprising a coating applicator configured to apply coating material to a moving strip of material when the moving strip is in a coating region, a frame configured to carry the coating applicator, the frame and the coating applicator cooperating to define the coating region, means for providing relative movement between the moving strip and the frame carrying the coating applicator so that the frame can be moved from an online position to an offline position away from the moving strip causing the moving strip to leave the coating region, and wherein the means for providing relative movement is configured to rotate the frame carrying the coating applicator about an axis of rotation between the online and offline positions.

4. A coating apparatus for coating a moving strip of material, the coating apparatus comprising a first coating applicator configured to apply coating material to a moving strip, and a frame carrying the first coating applicator and formed to include means for providing a coating region receiving a moving strip in an online position and means for providing an opening into the coating region through which the moving strip passes as the frame is moved at a non-parallel angle to the moving strip away from the online position to assume an offline position where the moving strip lies outside the coating region.

5. The coating apparatus of claim 4, further comprising a second coating applicator, and wherein the frame includes an upper arm, a lower arm spaced apart from the upper arm, and a support base interconnecting the upper arm and the lower arm, the upper arm carries the first coating applicator, and the lower arm carries the second coating applicator.

6. The coating apparatus of claim 5, wherein the upper arm includes a first proximal end mounted on the support base and a first distal end, the lower arm includes a second proximal end mounted on the support base and a second distal end spaced apart from the first distal end to form the opening.

7. The coating apparatus of claim 5, wherein the support base, the upper arm, and the lower arm cooperate with one another so that the frame is C-shaped.

8. A coating apparatus for coating a moving strip of material, the coating apparatus comprising a first coating applicator configured to apply coating material onto a first surface of a moving strip of material when the moving strip is in a region, a second coating applicator configured to apply coating material onto a second surface of the moving strip when the moving strip is in the region, a frame including a first arm carrying the first coating applicator, a second arm carrying the second coating applicator, and a support base coupled to the first arm and the second arm, the first arm carries the first coating applicator, the second arm carries the second coating applicator, the support base, the first arm, and the second arm cooperate to define the region, the first arm includes a first distal end, the second arm includes a second distal end spaced apart from the first distal end to form an opening that opens into the region, and means for moving the moving strip out of the coating region through the opening formed in the frame while the moving strip continues to move.

9. The coating apparatus of claim 8, wherein the first arm includes a first proximal end mounted on the support base, the second arm includes a second proximal end mounted on the support base, the first distal end and the second distal end are spaced apart from the support base.

10. The coating apparatus of claim 8, wherein the first arm is spaced apart from the second arm and the support base interconnects the first arm and the second arm.

11. The coating apparatus of claim 8, wherein the frame is C-shaped.

12. A coating apparatus for coating a strip of material, the coating apparatus comprising a first set of coating applicators configured to apply coating material onto a moving strip of material, the first set of coating applicators defining a first coating region to receive the moving strip, a second set of coating applicators configured to apply coating material onto the moving strip of material, the second set of coating applicators defining a second coating region to receive the moving strip, means for moving the first set of coating applicators online so that the moving strip is in the first coating region to receive coating material from the first set of coating applicators and offline so that the moving strip is outside of the first coating region and for moving the second set of coating applicators online in which the moving strip is in the second coating region to receive coating material from the second set of coating applicators and offline in which the moving strip is outside of the second coating region.

13. The coating apparatus of claim 12, wherein the means for moving includes a rail and a frame coupled to at least one of the first set of coating applicators and the second set of coating applicators and configured to be shuttled online and offline along the rail.

14. The coating apparatus of claim 13, wherein the means for moving includes a second rail and a second frame coupled to the other of the at least one of the first set of coating applicators and the second set of coating applicators and configured to be shuttled online and offline along the second rail.

15. The coating apparatus of claim 14, wherein the means for moving is configured to move each of the first set of coating applicators and the second set of coating applicators online so that the moving strip is in the first coating region and the second coating region.

16. The coating apparatus of claim 12, wherein the means for moving is configured to rotate the first set of coating applicators and the second set of coating applicators online and offline about an axis of rotation.

17. The coating apparatus of claim 12, further comprising alignment means, including a rack and a pinion, for maintaining a longitudinal axis of at least one of the coating applicators parallel to a surface of the moving strip as the surface passes through at least one of the first coating region and the second coating region without rotation of the at least one of the coating applicators about the longitudinal axis.

18. A coating apparatus for coating a strip of material, the coating apparatus comprising a frame, an applicator configured to apply coating material onto a strip of material, the applicator including a coater edge configured to contact the strip, an applicator mover configured to move the applicator relative to the frame between a coating position wherein the applicator is positioned to apply coating material onto the strip and a non-coating position spaced apart from the coating position, alignment means for maintaining a longitudinal axis of the applicator parallel to a surface of the strip and preventing the applicator from rotating about the longitudinal axis when the applicator mover moves the applicator between the coating and non-coating positions.

19. The coating apparatus of claim 18, wherein the alignment means includes a first rack-and-pinion unit including a first rack coupled to the frame and a first pinion coupled to the first rack.

20. The coating apparatus of claim 18, wherein the alignment means includes a shaft and a second rack-and-pinion unit including a second rack coupled to the frame and a second pinion coupled to the second rack, and the shaft is coupled to the first and second pinions and coupled with the applicator to move with the applicator.

* * * * *